US005640913A

United States Patent [19]

Nyyssonen

[11] Patent Number: 5,640,913

[45] Date of Patent: Jun. 24, 1997

[54] AFTERBURNER FOR VARIOUS FURNACES

[76] Inventor: Pekka Nyyssonen, Huruslahti, FIN-78210 Varkaus, Finland

[21] Appl. No.: 505,205

[22] PCT Filed: Feb. 15, 1994

[86] PCT No.: PCT/FI94/00061

§ 371 Date: Aug. 14, 1995

§ 102(e) Date: Aug. 14, 1995

[87] PCT Pub. No.: WO94/19649

PCT Pub. Date: Sep. 1, 1994

[30] Foreign Application Priority Data

Feb. 16, 1993 [FI] Finland ..... 930670

[51] Int. Cl.[6] ..... F23B 5/00

[52] U.S. Cl. ..... 110/212; 110/204; 432/72

[58] Field of Search ..... 110/210–212, 345, 110/204; 432/72

[56] References Cited

U.S. PATENT DOCUMENTS

| | | | |
|---|---|---|---|
| 2,965,051 | 12/1960 | Kocee . | |
| 3,403,645 | 10/1968 | Flowers, Jr. | 110/212 |
| 3,797,415 | 3/1974 | Young, Jr. et al. . | |
| 3,858,533 | 1/1975 | Lowe . | |
| 4,128,065 | 12/1978 | Kelly et al. | 110/211 |
| 4,718,357 | 1/1988 | Wang et al. | 110/210 X |
| 4,878,839 | 11/1989 | Wunning . | |
| 5,415,112 | 5/1995 | Takahashi | 110/204 X |
| 5,460,511 | 10/1995 | Grahn | 110/211 X |

FOREIGN PATENT DOCUMENTS

| | | |
|---|---|---|
| 92107152 | 11/1992 | European Pat. Off. . |
| 64241 | 8/1892 | Germany . |
| 3729971 | 3/1989 | Germany . |

OTHER PUBLICATIONS

Derwent's Abstract No. 85–274823/44, week 8544, Abstract of SU, 1151769 (Tekhenegokhimprom) dated Apr. 23, 1985.

*Primary Examiner*—Henry A. Bennett
*Assistant Examiner*—Susanne C. Tinker
*Attorney, Agent, or Firm*—Woodard, Emhardt, Naughton, Moriarty & McNett

[57] ABSTRACT

The invention relates to an afterburner for various incinerators, said afterburner (3) including a housing portion provided with a smoke delivering pipe (2) for carrying the smokes coming from an incinerator firing chamber (1) into the afterburner chamber. The chamber (3) is provided with a burner (7), for example an oil burner or a gas burner. The chamber (3) is further fitted with a smoke dispensing box (9), whereby the particles not yet incinerated are recycled back into the fling chamber (1) and the flue gases are delivered into a flue gas scrubber (12). Between the afterburner (3) and the smoke dispensing box (9) is a wall (16) including a perforated section. The afterburner (3) comprises a preferably circularly cylindrical housing portion, having its ends sealed with end plates for creating a substantially sealed chamber, the burner (7) being mounted on one of the end plates for directing the burner flame substantially lengthwise of the afterburner and, thus, when in operation, the afterburner (3) is substantially filled with flames for an intensified combustion of particles thereby.

8 Claims, 2 Drawing Sheets

AFTERBURNER FOR VARIOUS FURNACES

The present invention relates to an afterburner for various furnaces and incinerators.

BACKGROUND OF THE INVENTION

One common problem associated with various incinerators involves harmful flue gases, especially when aiming to incinerate hazardous waste, such as packaging plastics, automobile tires or cable scrap. Another problem in addition to flue gas hazards is a generally poor efficiency. Efforts have been made to overcome these drawbacks by providing the incinerators with one or more afterburners for a more effective combustion of particles not yet incinerated. However, these prior known afterburners have not so far completely eliminated the above problems.

SUMMARY OF THE INVENTION

An object of the invention is to provide an improved afterburner, whereby the incinerators will be capable of burning also hazardous waste without pollution. In order to achieve this object, an afterburner of the invention is characterized by what is set forth in the characterizing section of claim 1.

One advantage offered by an apparatus of the invention is e.g. that the incinerator is capable of operating without a smoke stack, whereby the environmental hazards caused by smoke are practically eliminated and, in addition, the ash formation remains non-existent and the scrap metal can be substantially recovered.

BRIEF DESCRIPTION OF THE DRAWINGS FIGURES

The invention will now be described with reference made to the accompanying drawings, in which:

FIG. 1 shows a schematic side view of an incinerator using an afterburner of the invention, FIG. 2 shows an enlarged side view of an afterburner, and FIG. 3 shows a plan view of the afterburner of FIG. 2.

The incinerator of FIG. 1 includes a firing chamber 1 provided with a grate-like bed for waste 8. The firing chamber 1 is provided with a sizable gate for the easy loading of waste on the grate.

DETAILED DESCRIPTION OF THE PREFERRED EMBODIMENT

Figure 1:
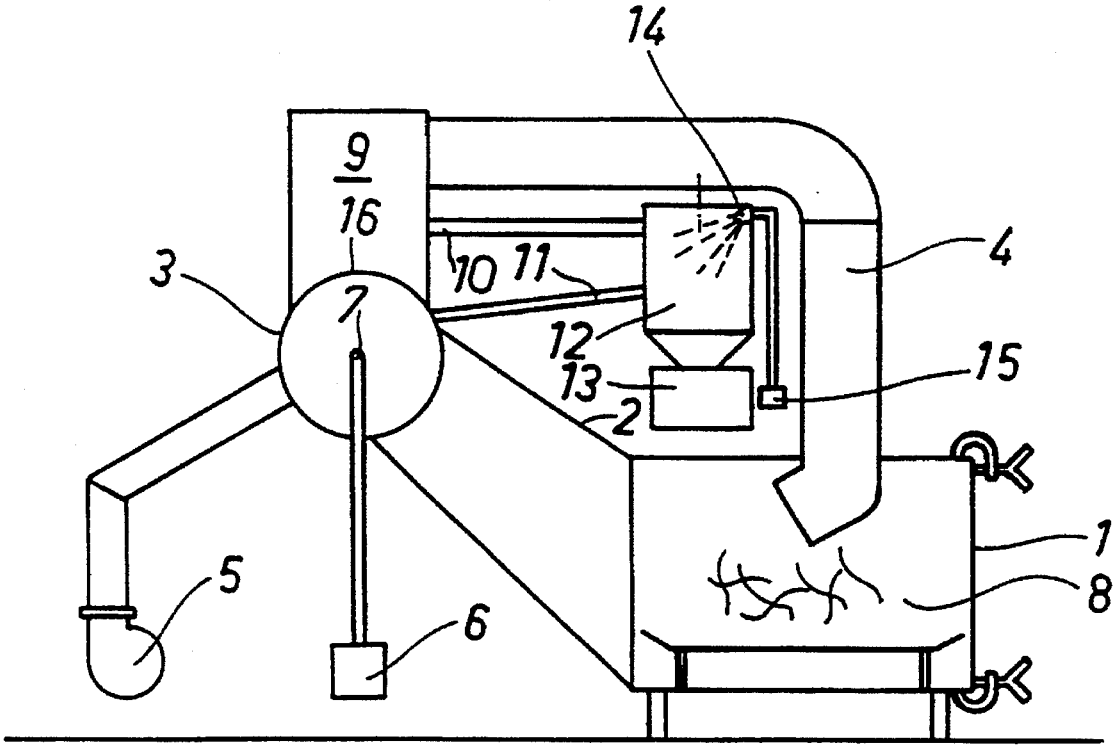
Figure 2:
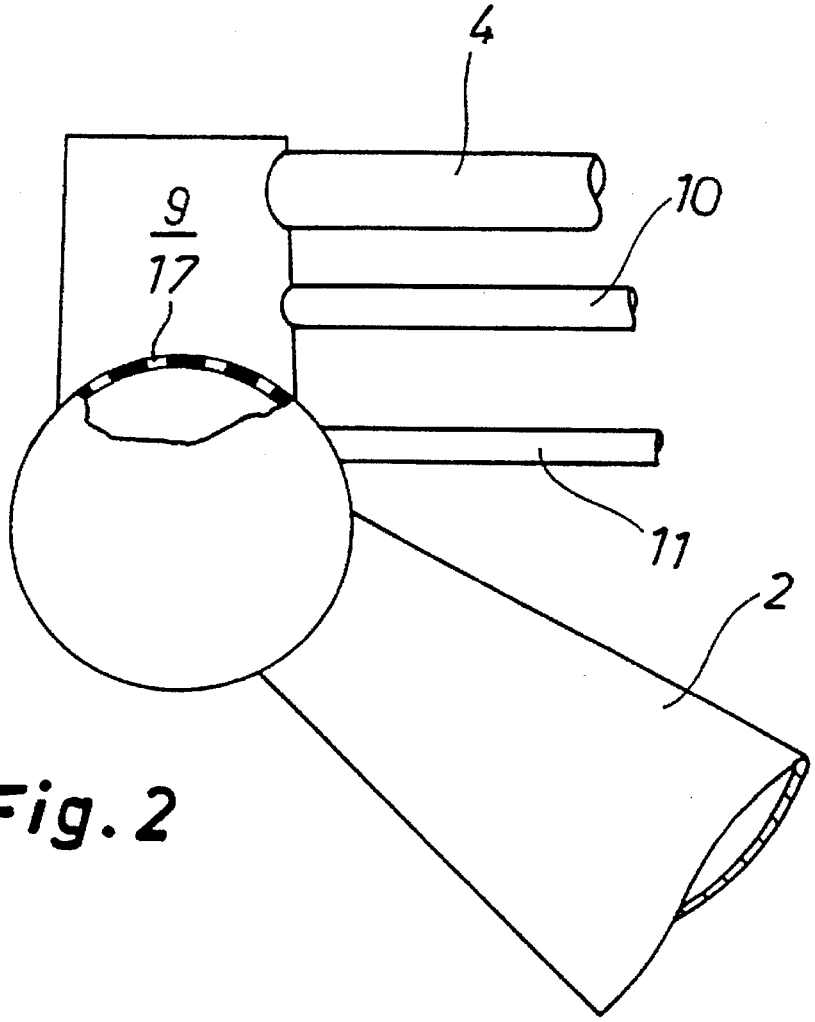
Figure 3:
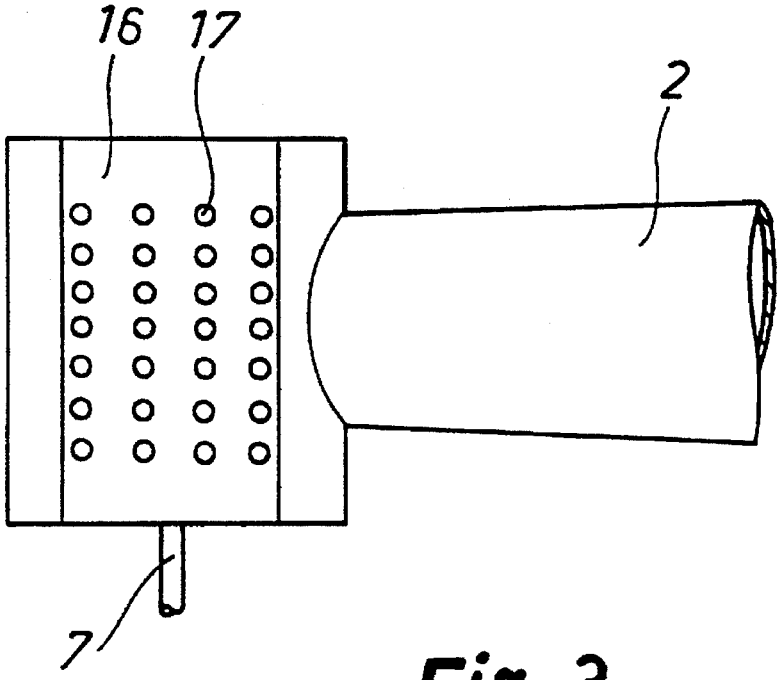

Waste 8 is set on fire for example by means of oil and it can burn on the grate. Depending on the type of waste, it is possible to employ some other kindling as well and other contributory fuels, such as wood or oil. Air can also be blown into the incinerator. The end of firing chamber 1 opposite to the gate is provided with a discharge flue 2, which forms a smoke delivering cone connected to an afterburner 3. The afterburner 3 is fitted with a pneumatically operating oil burner 7, provided with an oil pump which is indicated by reference numeral 6. The afterburner 3 is further provided with a supplementary air blower 5 for creating in the afterburner a sufficiently high temperature for dispersing the harmful constituents of flue gases, said temperature being appr. 1500° C.

From afterburner 3 the gases are delivered into a smoke dispensing box 9, wherefrom some of the gases are returned along a duct 4 into the firing chamber 1 for a more complete combustion of particles still contained in the gases. Some of the gases are delivered into a scrubber 12 along a pipe 10. Also from the afterburner 3 extends a smoke pipe 11 to the scrubber 12. The scrubber 12 includes a circulating water pump 15 and a scrubbing nozzle 14 as well as a receiver 13 for solid matter. The flue gases discharge from the combustion cycle only into the scrubber 12 and further therefrom through the receiver 13 into the atmosphere, whereby a possible solid matter remains in the receiver.

In order to achieve the combustion of particles as effectively as possible, the afterburner 3 is provided with a wall 16 including perforations 17 for passing the flue gases through said perforations. Without binding to theory, it is assumed that such a perforated wall decelerates the passage of flue gases for a more effective combustion of particles. The perforations 17 are preferably appr. 30 mm in size and disposed for example in four rows extending lengthwise of the afterburner 3, the perforation pitch being for example 40×40 mm.

The afterburner 3 comprises a preferably circularly cylindrical housing portion, having its ends sealed with end plates for providing a substantially sealed chamber. The oil burner 7 is preferably mounted on one of the end plates for directing the oil burner flame substantially lengthwise of the afterburner chamber and, thus, when in operation, said afterburner 3 is essentially filled with flames for an intensified combustion of particles thereby. The area equipped with perforations 17 extends preferably over a large part of the length of the housing portion of the chamber 3 but remains nevertheless at a distance from the oil burner 7 in the longitudinal direction of the housing portion. Of course it is possible to provide the afterburner with a burner other than an oil burner, such as e.g. a gas burner whose fuel comprises e.g. natural gas or liquid gas.

An afterburner of the invention can be readily fitted in the existing incinerators, the flue of an incinerator being fitted with an additional firing chamber of the invention along with its flue gas scrubber and other equipment.

An afterburner of the invention is particularly suitable for incinerators of various hazardous wastes, which produce plenty of harmful flue gases when incinerating for example tires, cables and the like.

I claim:

1. An afterburner for various incinerators, said afterburner (3) including a housing portion provided with a smoke delivering pipe (2) for carrying the smokes coming from an incinerator firing chamber (1) into the afterburner chamber, said chamber (3) being provided with a burner (7) and said chamber (3) being further fitted with a smoke dispensing box (9), whereby the particles not yet incinerated are recycled back into the firing chamber (1) and the flue gases are delivered into a flue gas scrubber (12), characterized by the following combination: between the afterburner (3) and the smoke dispensing box (9) is a wall (16) including a perforated section;

the afterburner (3) comprises a circularly cylindrical housing portion, having its ends sealed with end plates for creating a substantially sealed chamber; the burner (7) included in said chamber (3) is mounted on one of the end plates for directing the burner flame substantially lengthwise of the afterburner (3), and the afterburner (3) is provided with an air blower (5) for supplying compressed air into the chamber (3) and, thus, when in operation, the afterburner (3) is substantially filled with flames for an intensified combustion of particles thereby.

2. An afterburner as set forth in claim 1, characterized in that the perforations (17) are appr. 30 mm in diameter.

3. An afterburner as set forth in claim 1, characterized in that the perforations (17) are arranged with a perforation pitch of appr. 40×40 mm.

4. An after burner as set forth in claim 1, characterized in that the burner (7) included in the chamber is an oil burner or a gas burner.

5. An afterburner as set forth in claim 2, characterized in that the perforations (17) are arranged with a perforation pitch of appr. 40×40 mm.

6. An after burner as set forth in claim 2, characterized in that the burner (7) included in the chamber is an oil burner or a gas burner.

7. An after burner as set forth in claim 3, characterized in that the burner (7) included in the chamber is an oil burner or a gas burner.

8. An after burner as set forth in claim 5, characterized in that the burner (7) included in the chamber is an oil burner or a gas burner.

* * * * *